US009199386B2

(12) United States Patent
Muto

(10) Patent No.: US 9,199,386 B2
(45) Date of Patent: Dec. 1, 2015

(54) CUTTING DATA GENERATOR, CUTTING APPARATUS AND NON-TRANSITORY COMPUTER-READABLE MEDIUM STORING CUTTING DATA GENERATING PROGRAM

(71) Applicant: Yukiyoshi Muto, Nagoya-shi (JP)

(72) Inventor: Yukiyoshi Muto, Nagoya-shi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 216 days.

(21) Appl. No.: 14/142,279

(22) Filed: Dec. 27, 2013

(65) Prior Publication Data

US 2014/0182432 A1 Jul. 3, 2014

(30) Foreign Application Priority Data

Dec. 27, 2012 (JP) ..... 2012-284947

(51) Int. Cl.
*B26D 5/00* (2006.01)
*B26F 1/38* (2006.01)

(52) U.S. Cl.
CPC ..... *B26D 5/005* (2013.01); *B26D 5/007* (2013.01); *B26F 1/3806* (2013.01); *Y10T 83/175* (2015.04)

(58) Field of Classification Search
CPC ..... B26D 5/005; B26D 5/007; Y10T 83/175; B26F 1/3806
USPC ..... 83/76.7
See application file for complete search history.

(56) References Cited

U.S. PATENT DOCUMENTS 3,633,286 A 1/1972 Maurer
3,875,389 A * 4/1975 McFadden ..... G05B 13/042 33/11
5,621,221 A 4/1997 Shinohara et al.
6,128,546 A * 10/2000 Basista ..... G05B 19/4205 219/121.67
6,205,370 B1 * 3/2001 Blaimschein ..... B26D 5/00 382/111
6,295,370 B1 * 9/2001 D'Hooge ..... A63F 9/08 382/162
6,359,251 B1 * 3/2002 Picard ..... B23K 10/00 219/121.39
7,469,620 B2 * 12/2008 Fagan ..... B23K 7/105 219/121.67

(Continued)

FOREIGN PATENT DOCUMENTS

JP 2005254707 A 9/2005
JP 2014-124747 A 7/2014
JP 2014-124748 A 7/2014

OTHER PUBLICATIONS

You Tube video entitled "Create Rhinestone with Fairy Cut and Cricut Expression" by Fairycut published on Jan. 26, 2011 available at https://www.youtube.com/watch?v=HgWs-SVst6g.

(Continued)

*Primary Examiner* — Sean Michalski
(74) *Attorney, Agent, or Firm* — Fox Rothschild LLP

(57) ABSTRACT

A cutting data generator generating cutting data includes a control device configured to obtain position information of a plurality of figures printed on a sheet material, the figures representing an arrangement of a plurality of types of decorative pieces having at least different colors, the figures being capable of identifying the types of the decorative pieces, to set arrangement positions of a plurality of holes in the sheet material based on the obtained position information, the arrangement positions being positions where the holes partially overlap the figures respectively or where the holes come close to the figures respectively, the holes defining an arrangement of the decorative pieces, and to generate cutting data usable to cut the holes through the sheet material based on the set arrangement positions.

14 Claims, 13 Drawing Sheets

(56) References Cited

U.S. PATENT DOCUMENTS

| | | | | |
|---|---|---|---|---|
| 8,270,709 | B2 * | 9/2012 | Lindbloom | G06K 9/4652 382/162 |
| 9,089,982 | B2 * | 7/2015 | Tokura | B26D 5/007 |
| 2003/0083850 | A1 * | 5/2003 | Schmidt | G06T 7/001 702/189 |
| 2004/0083862 | A1 * | 5/2004 | Mikkelsen | B26F 1/3813 83/13 |
| 2005/0076998 | A1 * | 4/2005 | Buffum | B44C 1/105 156/230 |
| 2005/0120844 | A1 * | 6/2005 | Weber | B26D 5/007 83/35 |
| 2007/0157776 | A1 * | 7/2007 | Sorensen | A22C 17/002 83/23 |
| 2009/0064832 | A1 * | 3/2009 | Caretta | B23K 26/0093 83/76.7 |
| 2011/0073519 | A1 | 3/2011 | Davis, II et al. | |
| 2011/0283849 | A1 * | 11/2011 | Takizawa | B26D 5/005 83/13 |
| 2012/0078406 | A1 * | 3/2012 | Lee | B23K 26/0604 700/103 |
| 2012/0234482 | A1 * | 9/2012 | Ihm | B44D 2/007 156/249 |
| 2013/0177215 | A1 * | 7/2013 | Campbell | B26F 1/3813 382/111 |
| 2013/0180374 | A1 * | 7/2013 | Abe | B26D 5/00 83/76.8 |
| 2014/0000433 | A1 * | 1/2014 | Yamamoto | B26D 5/007 83/886 |
| 2014/0182463 | A1 | 7/2014 | Muto | |
| 2014/0188268 | A1 | 7/2014 | Tashiro | |
| 2014/0283662 | A1 * | 9/2014 | Tokura | B26D 5/007 83/76.1 |

OTHER PUBLICATIONS

You Tube video entitled "Back to Basics Toys: Lite Brite Cube" by Scholastic published on Nov. 20, 2009 available at https://www.youtube.com/watch?v=1oCJWmCQty0.

You Tube video entitled "Using Gypsy and Cricut Markers" by Williams published on Sep. 13, 2011 available at https://www.youtube.com/watch?v=h40ttgv5t0w.

You Tube video entitled "Cricut Markers—Draw and then Cut a Shape" by Hamer published on Jun. 11, 2010 available at https://www.youtube.com/watch?v=PIC5EytTt3w.

* cited by examiner

CUTTING DATA GENERATOR, CUTTING APPARATUS AND NON-TRANSITORY COMPUTER-READABLE MEDIUM STORING CUTTING DATA GENERATING PROGRAM

CROSS-REFERENCE TO RELATED APPLICATIONS

This application is based upon and claims the benefit of priority from the prior Japanese Patent Application No. 2012-284947 filed on Dec. 27, 2012, the entire contents of which are incorporated herein by reference.

BACKGROUND

1. Technical Field

The present disclosure relates to a cutting data generator generating cutting data for forming holes in a sheet using a cutting apparatus, in which holes decorative pieces are disposed, the cutting apparatus and a non-transitory computer-readable medium storing a cutting data generating program.

2. Related Art

Clothes and small goods have conventionally been decorated with decorative pieces "rhinestones." The rhinestone has a rear surface provided with a hot-melt layer which is caused to adhere to clothes by an ultrasonic welding machine or a clothes iron thereby to be fixed. A rhinestone positioning sheet or a plate (a ruler) is used in the fixing work in order to desirably arrange the rhinestones. For example, the ruler has a number of holes in which the rhinestones are fitted respectively. The holes are arranged in a linear or curved shape. Furthermore, the holes are formed so as to be arranged into an outline of a pattern such as a square or heart or another shape. A user places the ruler on the clothes and fits rhinestones into the holes into a desired arrangement, positioning the rhinestones. The positioned rhinestones are caused to adhere to the clothes using an ultrasonic welding machine.

A number of colors of rhinestones such as red and blue are prepared and the rhinestones of favorite colors are arranged with the use of the rule, with the result that the user can enjoy colorful decoration.

However, when a decoration is made using a plurality of colors of rhinestones, the user is required to carry out a troublesome work of arranging the individual rhinestones in the respective holes of the ruler according to the colors. More specifically, the user repeatedly arranges and fixes rows of rhinestones one by one using the linearly arranged holes of the ruler when making a decoration with the rhinestones being arranged in rows and columns. In this case, the user is required to manually select the rhinestones one by one without mistaking the color while imaging an entire coloration. This requires a huge amount of effort when a number of rhinestones are used.

SUMMARY

Therefore, an object of the disclosure is to provide a cutting data generator for making a sheet material, which can arrange a plurality of types of decorative pieces with different colors in an easy and accurate manner.

The present disclosure provides a cutting data generator generating cutting data including a control device configured to obtain position information of a plurality of figures printed on a sheet material, the figures representing an arrangement of a plurality of types of decorative pieces having at least different colors, the figures being capable of identifying the types of the decorative pieces, to set arrangement positions of a plurality of holes in the sheet material based on the obtained position information, the arrangement positions being positions where the holes partially overlap the figures respectively or where the holes come close to the figures respectively, the holes defining an arrangement of the decorative pieces, and to generate cutting data usable to cut the holes through the sheet material based on the set arrangement positions.

The disclosure also provides a non-transitory computer-readable storage medium storing computer-readable instructions that, when executed by a processor, cause the processor to perform the above-described steps.

The disclosure further provides a cutting apparatus including a cutting instrument configured to print on a sheet material, a cutting instrument configured to cut the holes through the sheet material based on the cutting data.

DETAILED DESCRIPTION

Figure 1:
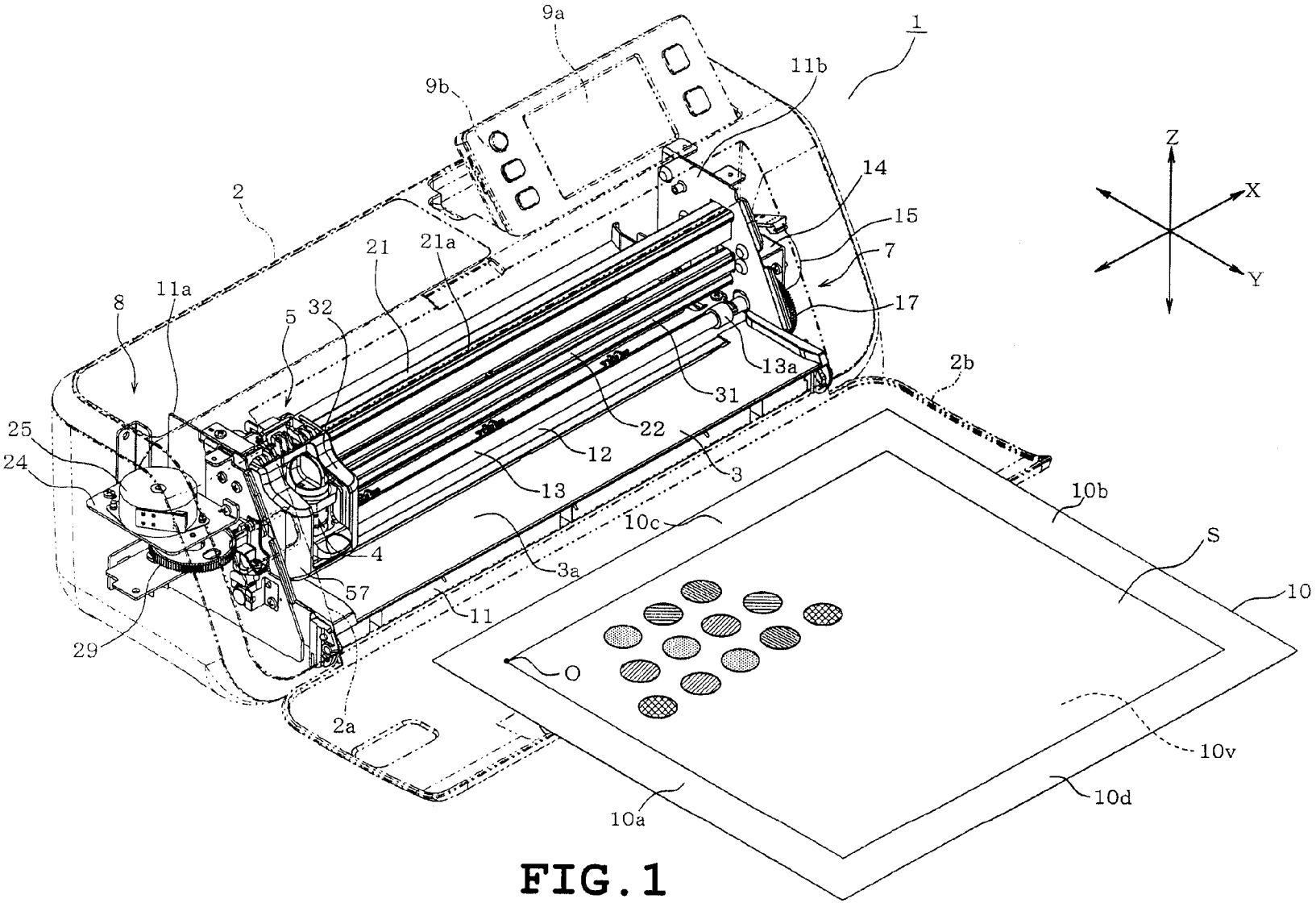
FIG. 1 is a perspective view of a cutting apparatus in accordance with a first example, showing an inner structure of the apparatus together with a body cover.

A first example will be described with reference to FIGS. 1 to 13 of the accompanying drawings. Referring to FIG. 1, a cutting apparatus 1 of the first example includes a body cover 2 serving as a housing, a platen 3 set up in the body cover 2, a carriage 5 on which is mounted a cartridge 4 (see FIG. 5) and scanner 6 serving as an image reading instrument (see FIGS. 2 and 6).

The cutting apparatus 1 also includes a holding sheet 10 which holds an object S to be cut or to be read. For example, the holding sheet 10 holds the object S such as a resin sheet or paper on each of which a figure as an original for generation of cutting data is drawn, as shown in FIG. 1.

The body cover 2 is formed into a horizontally long rectangular box shape and includes a front formed with a front opening 2*a* and a front cover 2*b* mounted so as to openably close the front opening 2*a*. The holding sheet 10 holding the object S is set on the platen 3 or the cartridge 4 is attached to or detached from a cartridge holder 32 of the carriage 5 while the front opening 2*a* is open.

The cutting apparatus 1 includes a transfer mechanism 7 which transfers the object S in a predetermined transfer direction (the Y direction). The cutting apparatus also includes a carriage moving mechanism 8 which moves the carriage 5 in a direction intersecting with the transfer direction of the object S (the X direction perpendicular to the transfer direction, for example). In the following description, the direction in which the object S is transferred by the transfer mechanism 7 will be referred to as "a front-rear direction." More specifically, the front-rear direction is a Y-direction and a right-left direction perpendicular to the Y direction is the X direction.

A color liquid crystal display 9*a* and an operation device 9*b* including a plurality of operation switches are mounted on a right upper surface of the body cover 2. The display 9*a* is capable of performing full color display. The display 9*a* is configured to serve as an informing equipment and a display unit which displays necessary messages and a pattern to be cut, a shape or the like. The operation switches of the operation device 9*b* are configured to be operated by the user to select a pattern displayed on the display 9*a*, to set various parameters, to instruct various functions, to input various conditions, and the like.

Figure 2:
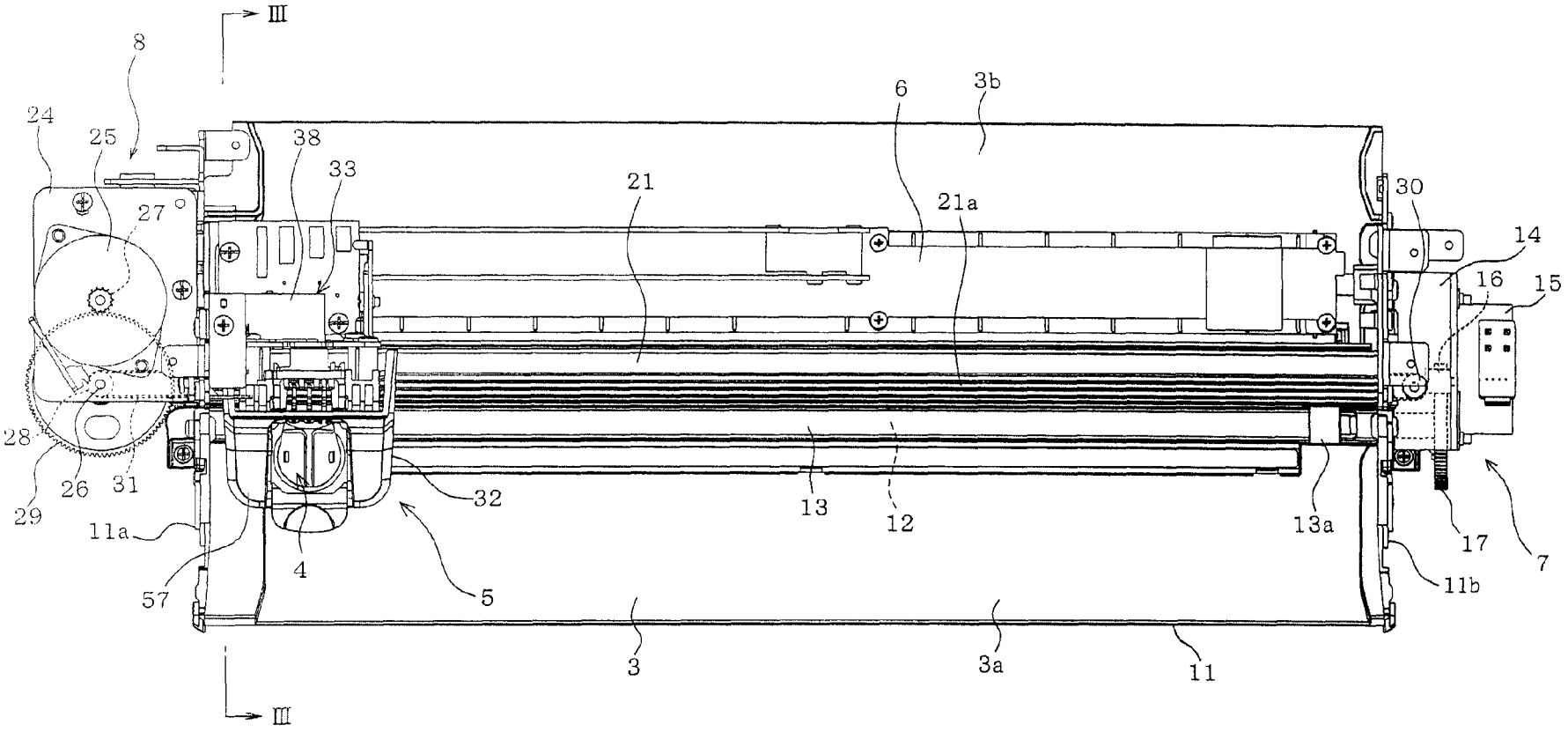
FIG. 2 is a plan view of the cutting apparatus, showing the inner structure thereof.

The platen 3 is adapted to receive the underside of the holding sheet 10 when the object S is cut. The platen 3 includes a front platen 3*a* and a rear platen 3*b* as shown in FIG. 2. The platen 3 has an upper surface which is substantially horizontal. The object S is transferred while the holding sheet 10 holding the object S is placed on the upper surface of the platen 3. The upper surface of the platen 3 has an adhesive layer 10*v* (see FIG. 1) formed by applying an adhesive agent to an inner area excluding peripheral ends 10*a* to 10*d*. The object S is affixed to the adhesive layer 10*v* thereby to be held by the holding sheet 10. The adhesive layer 10*v* has adhesive power set to a relatively smaller value so that the object S can easily be removed from the holding sheet 10. The transfer mechanism 7 and the carriage moving mechanism 8 serve as a relative movement unit which moves the holding sheet 10 holding the object S and the carriage 5 in the X and Y directions relative to each other.

The transfer mechanism 7 transfers the holding sheet 10 at the upper surface side of the platen 3 freely in the Y direction. More specifically, a frame 11 is enclosed in the body cover 2 as shown in FIGS. 1 and 2. The frame 11 includes right and left sidewalls 11*b* and 11*a* which are located at right and left sides of the platen 3 so as to face each other, respectively. A driving roller 12 and a pinch roller 13 are mounted on both sidewalls 11*a* and 11*b* so as to be located in a space between the front and rear platens 3*a* and 3*b*. The driving roller 12 and the pinch roller 13 extend in the X direction substantially in parallel to each other. The pinch roller 13 is located above the driving roller 12.

The driving roller 12 has an upper end which is substantially level with the upper surface of the platen 3 and right and left ends mounted on the right and left sidewalls 11*b* and 11*a* respectively so that the driving roller 12 is rotatable. The right end of the driving roller 12 extends rightward through the right sidewall 11*b* as shown in FIG. 2. A driven gear 17 having a large diameter is secured to a right distal end of the driving roller 12. A mounting frame 14 is fixed to an outer surface of the right sidewall 11*b*. A Y-axis motor 15 comprised of a stepping motor, for example is mounted on the mounting frame 14. The Y-axis motor 15 has an output shaft to which is fixed a driving gear 16 which has a small diameter and is to be brought into mesh engagement with the driven gear 17.

The pinch roller 13 has right and left ends mounted on the right and left sidewalls 11*b* and 11*a* respectively so that the pinch roller 13 is rotatable and slightly displaceable in the up-down direction. Two springs (not shown) are mounted on the outer surfaces of the right and left sidewalls 11*b* and 11*a* to normally bias the pinch roller 13 downward. Accordingly, the pinch roller 13 is normally biased downward (to the driving roller 12 side) by the springs. Two rollers 13*a* having a slightly large diameter are mounted on the pinch roller 13 so as to be located near both ends thereof respectively. Only the right roller 13*a* is shown in FIGS. 1 and 2.

The right and left ends 10*b* and 10*a* of the holding sheet 10 are thus held between the driving roller 12 and the rollers 13*a* of the pinch roller 13. Upon drive of the Y-axis motor 15, normal or reverse rotation of the Y-axis motor 15 is transmitted via the gears 16 and 17 to the driving roller 12, whereby the holding sheet 10 is transferred rearward or forward together with the object S. The transfer mechanism 7 is thus constituted by the driving roller 12, the pinch roller 13, the Y-axis motor 15 and the gears 16 and 17 serving as a reduction mechanism.

The carriage moving mechanism 8 serves to move the carriage 5 freely in the X direction. More specifically, as shown in FIGS. 1 and 2, a pair of guide rails 21 and 22 are fixed to the right and left sidewalls 11*b* and 11*a* so as to be located slightly rear above the pinch roller 13. The guide rails 21 and 22 extend in the right-left direction substantially in parallel to the pinch roller 13. Each of the guide rails 21 and 22 has a generally C-shaped section as viewed in the extending direction (the direction perpendicular to paper of FIG. 3). The upper guide rail 21 and the lower guide rail 22 are disposed to be symmetric with each other in the up-down direction so that both open surfaces are opposed to each other.

The upper guide rail 21 has an upper surface formed with a guide groove 21*a* extending from the left end to the right end thereof. The lower guide rail 22 has an underside also formed with a guide groove 22*a* (shown only in FIG. 3) extending from the left end to the right end thereof. Furthermore, the carriage 5 has upper and lower sides formed with protrusions 23 located in both guide grooves 21*a* and 22*a* respectively. The protrusions 23 extend in the right-left direction and engage the guide grooves 21*a* and 22*a* respectively. The carriage 5 is thus supported by the guide rails 21 and 22 so as to be slidable in the right-left direction.

A horizontal mounting frame 24 is fixed to the outer surface of the left sidewall 11*a* so as to be located near the rear of the cutting apparatus 1, as shown in FIGS. 1 and 2. An X-axis motor 25 is mounted on a rear part of the left mounting frame 24 to a downward direction. Furthermore, a vertically extending pulley shaft 26 (see FIG. 2) is mounted on the mounting frame 24 so as to be located in front of the X-axis motor 25. The X-axis motor 25 has an output shaft to which a driving gear 27 having a small diameter is fixed. A timing pulley 28 and a driven gear 29 having a large diameter are rotatably mounted on the pulley shaft 26. The driven gear 29 is brought into mesh engagement with the driving gear 27. The timing pulley 28 and the driven gear 29 are configured to be rotated together.

On the other hand, a timing pulley 30 is mounted on the right mounting frame 14 so as to be rotatable about an axis extending in the up-down direction. An endless timing belt 31 horizontally extends between the timing pulleys 30 and 28 in the right-left direction. The timing belt 31 has a midway part joined to a mounting part (not shown) of the carriage 5. The sidewalls 11*a* and 11*b* have through holes through which the timing belt 31 passes, respectively.

Upon drive of the X-axis motor 25, normal or reverse rotation of the X-axis motor 25 is transmitted via the gears 27 and 29 and the timing pulley 28 to the timing belt 31, whereby the carriage 5 is moved leftward or rightward. Thus, the carriage 5 is moved freely in the right-left direction perpendicular to the direction in which the object S is conveyed. The carriage moving mechanism 8 is thus constituted by the guide rails 21 and 22, the X-axis motor 25, the gears 27 and 29 serving as a reduction mechanism, the timing pulleys 28 and 30, the timing belt 31 and the like.

Figure 3:
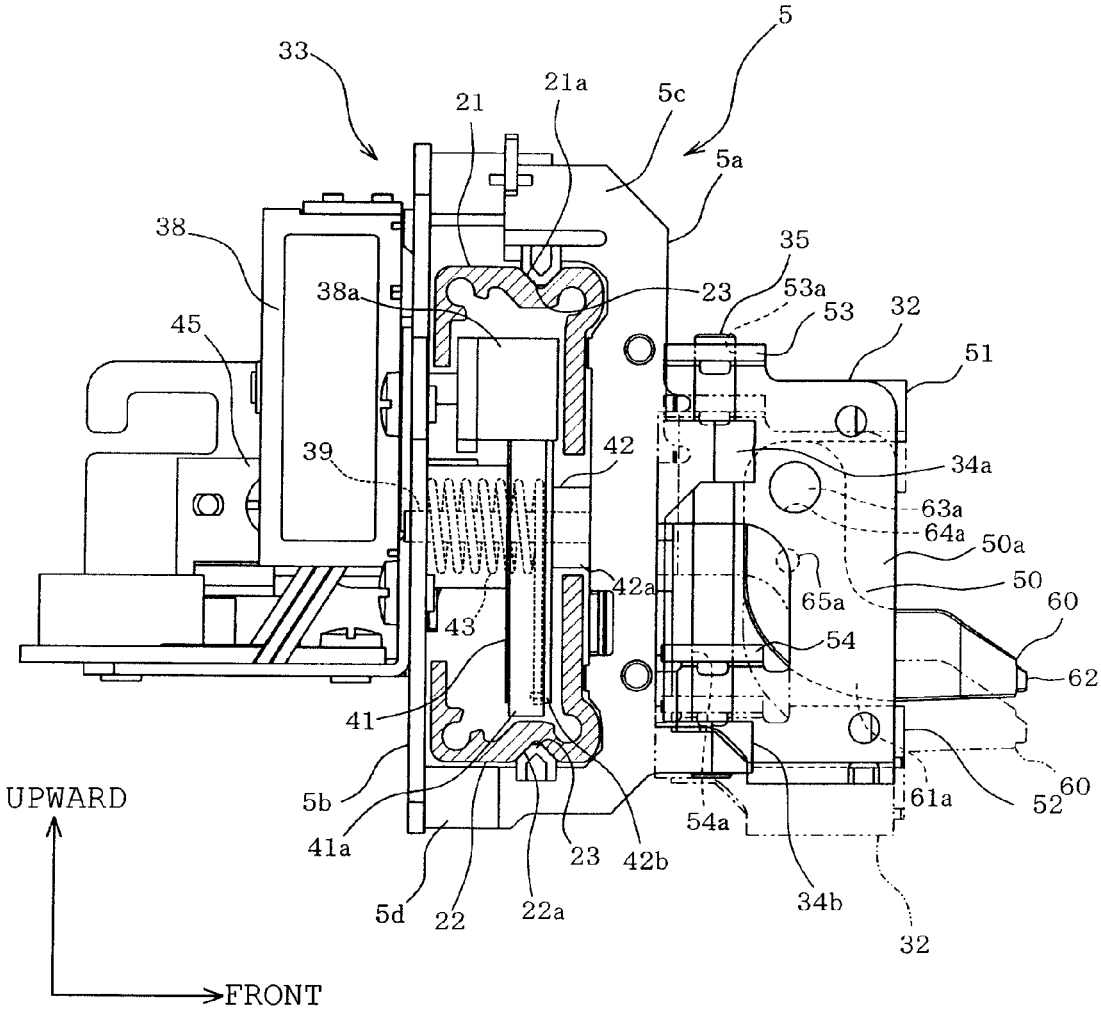
FIG. 3 is a longitudinal left side elevation taken along line III-III in FIG. 2.
Figure 4:
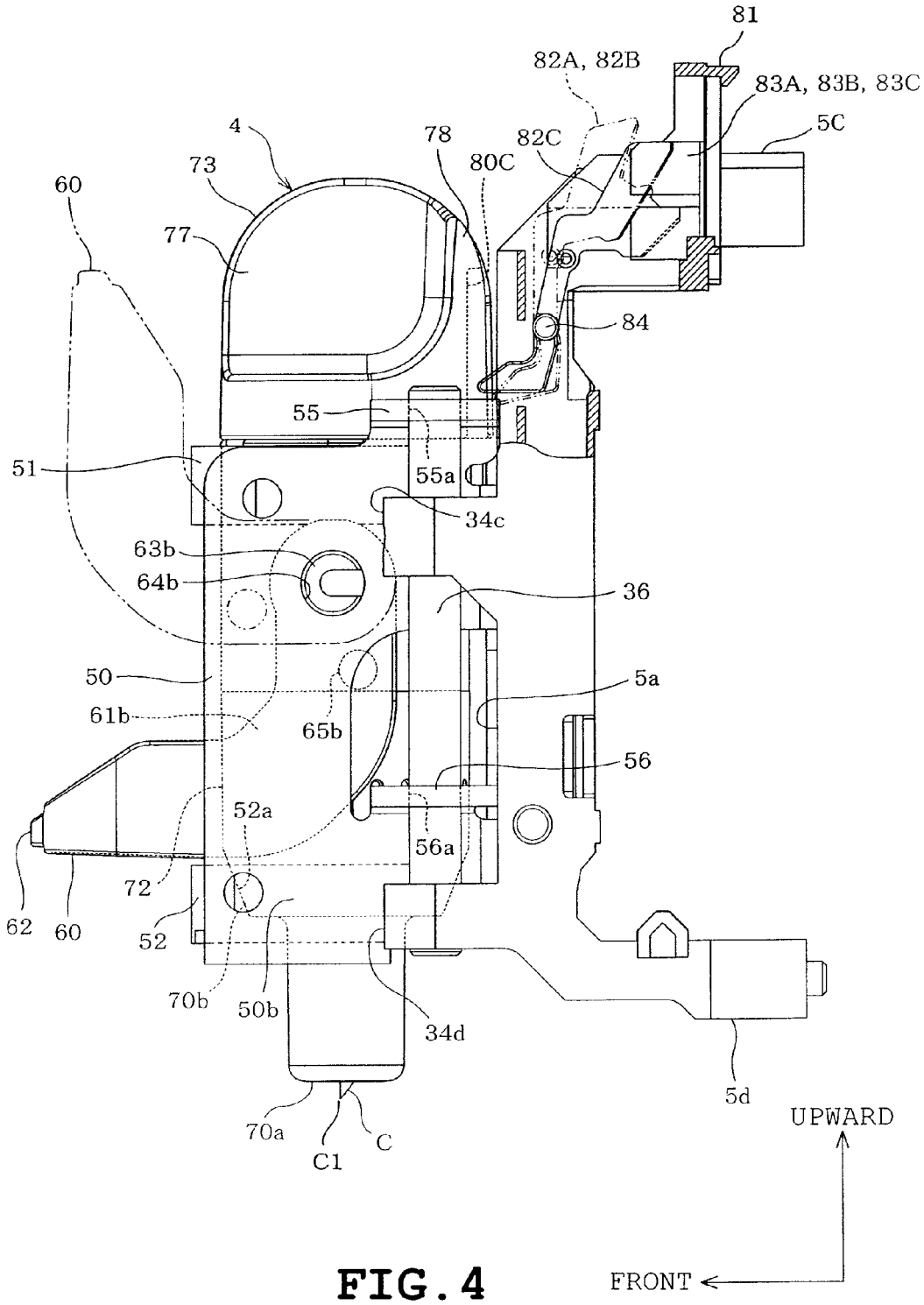
FIG. 4 is a right side elevation of a cartridge holder and its periphery with a cartridge being attached.

The carriage 5 includes an up-down drive mechanism 33 and a carriage holder 32 disposed back and forth as shown in FIGS. 2 and 3. The up-down drive mechanism 33 is configured to drive the cartridge holder 32 in the up-down direction (the Z direction) together with the cartridge 4. The carriage 5 includes front and rear walls 5*a* and 5*b* and upper and lower arms 5*c* and 5*d* connecting the walls 5*a* and 5*b*. Thus, the carriage 5 is shaped so as to surround the front and rear sides and upper and lower sides of the guide rails 21 and 22. A pair of upper and lower supports 34*a* and 34*b* are mounted on a left end of the front wall 5*a* so as to protrude frontward. A round-bar like shaft 35 is fixed to the supports 34*a* and 34*b* so as to extend through the supports 34*a* and 34*b* in the up-down direction. Other supports 34*c* and 34*d* are also mounted on the right end of the front wall 5*a* as shown in FIG. 4. A shaft 36 is fixed to the supports 34*c* and 34*d*. The shafts 35 and 36 are inserted through both sides (holes 53*a*, 54*a*, 55*a* and 56*a* of support pieces 53 to 56 as will be described later; and see FIGS. 3 and 4) of the cartridge holder 32, whereby the cartridge holder 32 is supported so as to be movable in the up-down direction.

The protrusion 23 engaging the guide groove 21*a* is provided on the upper arm 5*c* of the carriage 5 as shown in FIG. 3. The protrusion 23 engaging the guide groove 22*a* of the guide rail 22 is provided on the lower arm 5*d*. A Z-axis motor 38 is mounted on a slightly upper part of the rear wall 5*b* of the carriage 5 so as to be directed forward. The Z-axis motor 38 is comprised of a stepping motor, for example and has an output shaft to which a driving gear 38*a* having a small diameter is fixed. A gear shaft 39 extending frontward is mounted on the rear wall 5*b* of the carriage 5 so as to be located in the right-bottom side of the Z-axis motor 38. A driven gear member 41 and a pinion gear member 42 are rotatably supported on the gear shaft 39.

The driven gear member 41 has a small diameter portion and a large diameter portion both formed integrally therewith. A gear 41*a* to be brought into mesh engagement with the driving gear 38*a* is formed on the large diameter portion. The driven gear member 41 has an enclosure formed therein and having a front opening. A torsion coil spring 43 is enclosed in the enclosure as will be described late. The pinion gear 42 has a flange 42*b* and a small-diameter portion both formed integrally therewith. The flange 42*b* covers the enclosure of the driven gear member 41 from the front. A gear 42*a* is formed on the small-diameter portion of the pinion gear member 42. The torsion coil spring 43 as shown in FIG. 3 is enclosed in the enclosure of the driven gear member 41. The torsion coil spring 43 has one end locked at the driven gear member 41 side and the other end locked at the pinion gear member 42 side. A rack (not shown) formed integrally on the cartridge holder 32 is brought into mesh engagement with the gear 42*a* of the pinion gear member 42.

Upon drive of the Z-axis motor 38, normal or reverse rotation of the Z-axis motor 38 is transmitted via the driving gear 38*a*, the driven gear member 41, the torsion coil spring 43 and the pinion gear member 42 to the rack, whereby the cartridge holder 32 is moved upward or downward together with the cartridge 4. As a result, the cartridge holder 32 (the cartridge 4) moved between a lowered position (see alternate long and two short dashes line in FIG. 3) and a raised position. When the cartridge holder 32 is located at the lowered position, the cutting by the cutter C is executed (see the alternate long and two short dashes line in FIG. 3). When the cartridge holder 32 is located at the raised position, a blade edge C1 as shown in FIG. 4 is spaced away from the object S by a predetermined distance.

Figure 6:
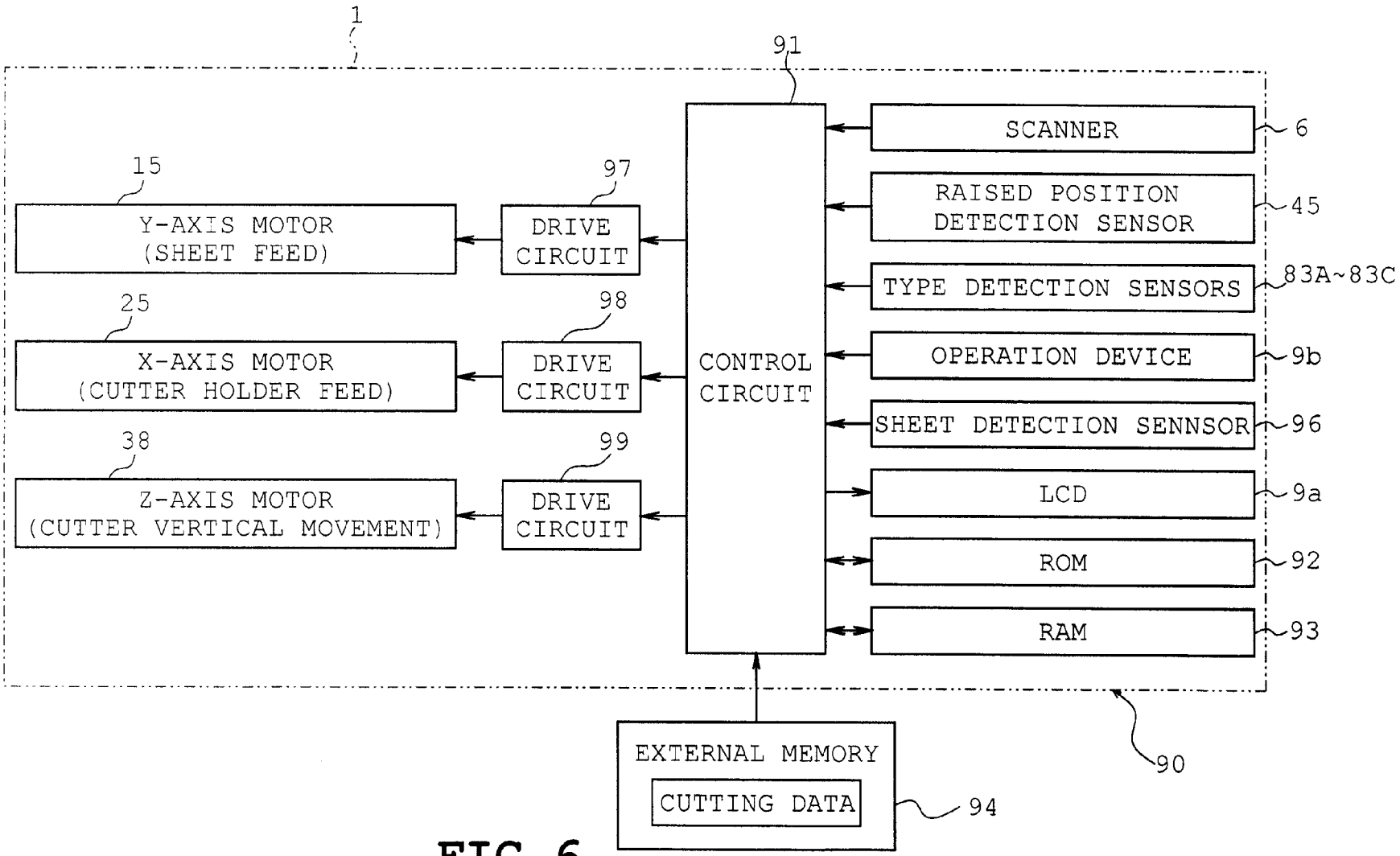
FIG. 6 is a block diagram showing an electrical arrangement of the cutting apparatus.

A raised position detection sensor 45 is mounted on a rear wall 5*b* of the carriage 5 to detect the raised position of the cartridge holder 32 although not shown in detail (see FIGS. 3 and 6). The raised position detection sensor 45 is an optical sensor and is comprised of a photointerrupter detecting a rotation position of a shutter piece (not shown) which is provided to be rotated with the driven gear member 41. As a result, the raised position of the cartridge holder 32 to which the cartridge 4 is attached is defined on the basis of a detection signal of the sensor 45. The up-down drive mechanism 33 is constituted by the Z-axis motor 38, the gear members 38*a*, 41 and 42 serving as the reduction mechanism, the torsion coil spring 43, the rack and the like.

Rotation of the Z-axis motor 38 is transmitted via the driven gear member 41 and the torsion coil spring 43 to the pinion gear member 42 to be converted to an up-and-down movement between the pinion gear member 42 and the rack. The conversion will be described in detail in the following. When the Z-axis motor 38 is driven to rotate clockwise as viewed at the front, the driven gear member 41 is rotated counterclockwise. The counterclockwise rotation of the driven gear member 41 rotates the pinion gear member 42 counterclockwise via the torsion coil spring 43. The counterclockwise rotation of the pinion gear member 42 is transmitted via the torsion coil spring 43 to the pinion gear member 42, so that the pinion gear member 42 is rotated counterclockwise. As the result of the counterclockwise rotation of the pinion gear member 42, the gear 42*a* moves the rack of the cartridge holder 32 downward. Thus, the cartridge holder 32 and accordingly the cartridge 4 are moved downward from the raised position. When the blade edge C1 of the cutter C and the underside 70*a* (see FIG. 4) of the cartridge 4 are pressed against the object S, further downward movement of the cartridge 4 is disallowed. In this case, the pinion gear member 42 is stopped since further rotation thereof is disallowed.

However, when the rotation of the Z-axis motor 38 is thereafter continued, only the driven gear member 41 is rotated with the result that the torsion coil spring 43 is flexed in a winding direction. The pressure for the cutting at the blade edge C1 side is set to a biasing force proportional to a deflection angle of the torsion coil spring 43. The pressure will hereinafter be referred to as "cutter pressure." Accordingly, when the cartridge holder 32 is located at the lowered position, a biasing force of the torsion coil spring 43 is set on the basis of an amount of rotation of the Z-axis motor 38, whereby a predetermined cutter pressure is obtained. On the other hand, even when the object S includes a concavo-convex part, the cutter C is allowed to be moved against the biasing force of the torsion coil spring 43 on the occasion of the relative movement of the object S and the cutter C by the transfer mechanism 7 and the carriage moving mechanism 8.

On the other hand, when the Z-axis motor 38 is driven to be rotated counterclockwise as viewed at the front, the driven gear member 41 is rotated clockwise. In the clockwise rotation of the driven gear member 41, the driven gear member 41 directly presses the pinion gear member 42, so that the pinion gear member 42 is rotated clockwise. More specifically, the torsion coil spring 43 does not work when the driven gear member 41 is rotated clockwise. The clockwise rotation of the pinion gear member 42 moves the gear 42*a* upward. Thus, the cartridge holder 32 and accordingly the cartridge 4 are moved upward from the lowered position.

The cartridge holder 32 includes a holder frame 50 formed with the rack and an upper holder 51 and a lower holder 52 both fixed to the holder frame 50 as shown in FIGS. 3 and 4. The holder frame 50 includes a top, an underside and a front all of which are open. The holder frame 50 has a left wall 50*a* formed with a pair of upper and lower support pieces 53 and 54 both protruding outward as shown in FIG. 3. The holder frame 50 also has a right wall 50*b* formed with a pair of upper and lower support pieces 55 and 56 both protruding outward as shown in FIG. 4. The support pieces 53 to 56 are formed with through holes 53*a* to 56*a* respectively.

The shaft 35 of the carriage 5 is inserted through the holes 53*a* and 54*a* of the left support pieces 53 and 54, and the shaft 36 of the carriage 5 is inserted through the holes 55*a* and 56*a* of the right support pieces 55 and 56. The holder frame 50 is thus supported so as to be movable in the up-down direction along the shafts 35 and 36 of the carriage 5. The carriage 5 is provided with a cover member 57 (see FIGS. 1 and 2) which covers the support pieces 53 to 56 of the holder frame 50 and the shafts 35 and 36. The cover member 57 has a central opening through which the upper and lower holders 51 and 52 and an inner wall of the holder frame 50 are exposed.

The upper and lower holders 51 and 52 are attached to the holder frame 50 so that the cartridge 4 is insertable through the holders 51 and 52. Each holder is formed into a frame shape so as to be fitted in the holder frame 50. Each of the holders 51 and 52 has an inner diameter set so that each holder is fitted with the outer periphery of the cartridge 4 to be attached. The lower holder 52 has a tapered portion 52*a* (see FIG. 4) which abuts against a tapered portion 70*b* of the cartridge 4 thereby to prevent downward movement of the cartridge 4.

The holder frame 50 is provided with a lever member 60 serving as a pressing unit which presses the cartridge 4. The lever member 60 has a pair of right and left arms 61*a* and 61*b* and an operating portion 62 provided so as to connect between distal end sides of the arms 61*a* and 61*b* as shown in FIGS. 3 and 4. The arms 61*a* and 61*b* are each formed into a plate shape and are disposed to sandwich both sides of the cartridge 4. Furthermore, the lever member 60 has a proximal end formed with small cylindrical pivot shafts 63*a* and 63*b* located at outer surface sides of the arms 61*a* and 61*b* respectively. The pivot shafts 63*a* and 63*b* are inserted through circular holes 64*a* and 64*b* formed in the walls 50*a* and 50*b* of the holder frame 50 respectively. As a result, the lever member 60 is swung about the pivot shafts 63*a* and 63*b* serving as a center of swinging motion so as to be switchable between an open position shown by alternate long and two short dashes line in FIG. 4 and a fixed position show by solid line in FIG. 4.

The arms 61*a* and 61*b* further have inner surfaces formed with small cylindrical engagement portions 65*a* and 65*b* located near the pivot shafts 63*a* and 63*b* respectively. The engagement portions 65*a* and 65*b* are disposed so as to engage an upper end of a cap 72 of the cartridge 4 from above when the lever member 60 is located at the fixed position, as will be described later. As the result of engagement of the engagement portions 65*a* and 65*b* and the cap 72, the cartridge 4 is fixed while in abutment with the tapered portion 52*a* of the lower holder 52 (see FIG. 4). On the other hand, with swing of the lever member 60 from the fixed position to the open position side, the engagement portions 65*a* and 65*b* depart from the cap 72, whereby the cap 72 is released from the fixed state. The lever member 60 thus presses the cartridge 4 by the engagement portions 65*a* and 65*b* thereby to releasably fix the cartridge 4.

The cartridge 4 includes a cutter C as a cutting instrument and a case 70 housing a round-bar shaped shaft C2. The cutter C includes the cutter shaft C2 as a base and a blade portion at a distal end (a lower end). The cutter shaft C2 and the blade portion are formed integrally with the cutter C. The blade portion of the cutter C is formed into a substantially triangular shape tilted relative to the object S.

The case 70 includes a case body 71 and the cap 72 and a knob 73 provided on one end and the other end of the body 71 respectively. The case body 71 is formed into a cylindrical shape and extends in the up-down direction. The case body 71 has right and left sides provided with escape portions 71*b* and 71*a* located midway in the up-down direction. The escape portions 71*a* and 71*b* are each formed into a concave shape in order to escape contact with the engagement portions 65*a* and 65*b* of the lever member 60. Bearings are provided in the case body 71 for supporting the cutter shaft C2 so that the cutter shaft C2 is rotatable about a central axis 70*c* although not shown in the drawings.

The cap 72 includes a larger-diameter portion 74 fitted with the case body 71 and a smaller-diameter portion 75 and is accordingly formed into the shape of a stepped bottomed cylindrical container. The larger-diameter portion 74 includes a frustoconical or tapered portion 70*b* which is formed over an entire circumference thereof and is in abutment with a tapered portion 52*a* of the cartridge holder 32. The tapered portion 70*b* of the larger-diameter portion 74 is set to the same inclination angle as the tapered portion 52*a* of the cartridge holder 32. The tapered portion 70*b* has a center corresponding with the central axis 70*c* of the cutter shaft C2. An upper end of the larger-diameter portion 74 or the peripheral end of the cap 72 is pressed by the engagement portions 65*a* and 65*b* of the lever member 60. The underside 70*a* of the cap 72 is formed into a flat shape and has a hole (not shown) through which the blade edge C1 of the cutter C or the pen tip P1 passes.

The knob 73 has a cover plate 76 fixed to an upper surface of the case body 71, a knob plate 77 and a rear plate 78 both formed on an upper side of the cover plate 77. The plates 76, 77 and 78 are formed integrally with the knob 73. The knob plate 77 is mounted on a central part of the cover plate 76 in the right-left direction so as to be directed vertically.

Figure 5:
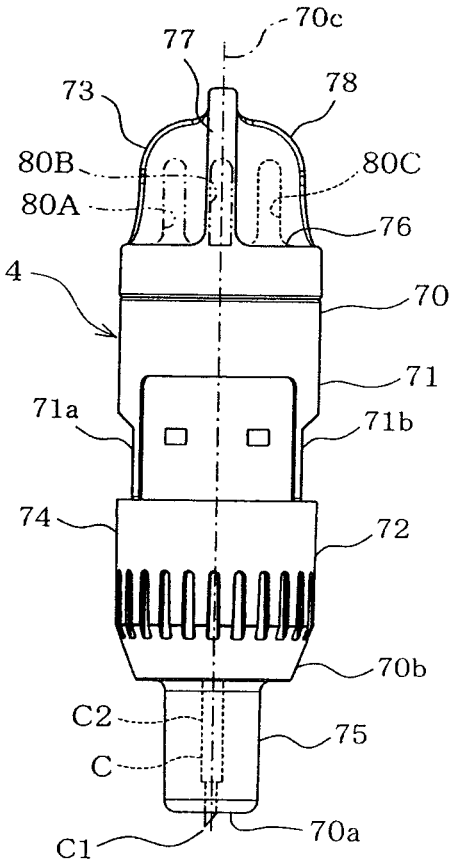
FIG. 5 is a front view of the cutter cartridge.

Any one of, for example, three grooves 80A to 80C is formed in the rear plate 78 of the knob 73 as shown in FIGS. 4 and 5. The grooves 80A to 80C serve as identification portions for identifying a type of the cartridge 4. The grooves 80A to 80C have different concavo-convex patterns according to types of the cartridges 4. More specifically, for example, another cartridge different from the cartridge 4 has no right groove 80C and a left groove 80A. Accordingly, the cartridge different from the cartridge 4 can be identified on the basis of presence or absence of the grooves 80A to 80C. Accordingly, seven types of cartridges can be identified by varying presence or absence of the grooves 80A to 80C on the rear plate 78.

The cartridge holder 32 of the carriage 5 is provided with a detection unit which identifies the type of the cartridge 4. The detection unit includes three contacts 82A to 82C mounted on a substrate holder 81 and three type detection sensors 83A to 83C mounted on a substrate of the substrate holder 81. More specifically, the substrate holder 81 is provided on an upper rear of the holder frame 50. The type detection sensors 83A to 83C are arranged in the right-left direction on the substrate holder 81 so as to correspond to the grooves 80A to 80C respectively. The type detection sensors 83A to 83C are optical sensors serving as detectors and comprise photointerrupters respectively.

The contacts 82A to 82C are formed into the shapes of plates extending from the rear plate 78 side of the knob 73 to the side of the type detection sensors 83A to 83C. The contacts 82A to 82C have shaft portions 84 formed midway in the lengthwise direction, respectively, as shown in FIG. 4. The substrate holder 81 is provided with bearings (not shown) supporting the shafts 84 so that the contacts 82A to 82C arranged in the thicknesswise direction are swingable. Three extension coil springs (not shown) are provided between raised portions of contacts 82A to 82C and the substrate holder 81 respectively. The contacts 82A to 82C are biased by the extension coil springs in a direction such that upper ends of the contacts 82A to 82C are tilted to the side of the type detection sensors 83A to 83C, that is, such that lower ends of the contacts 82A to 82C contact with the rear plate 78 of the knob 73.

For example, when the cartridge 4 has been attached to the cartridge holder 32, the lower ends of the contacts 82A and 82B contact with the rear plate 78 thereby to be swung. With this, the upper ends of contacts 82A and 82B depart from the type detection sensors 83A and 83B (see alternate long and two short dashes line in FIG. 4). On the other hand, the other contact 82C is retained in the tilted position such that the lower end thereof fits into groove 80C side and the upper end thereof fits into the type detection sensor 83C side.

In cutting the object S, a control circuit 91 (see FIG. 6), which will be described in detail later, controls the cartridge 4 attached to the cartridge holder 32 based on detection signals the contacts 82A to 82C, so that the cartridge 4 is moved to the lowered position by the up-down drive mechanism 33 to be set to the aforesaid cutter pressure. In this case, the blade edge C1 is thrust through the object S on the holding sheet 10 slightly into the holding sheet 10. In this state, the holding sheet 10 and the cartridge 4 (the cutter C) are moved in the X and Y directions relative to each other, whereby a cutting operation for the object S is executed. An X-Y coordinate system is set in the cutting apparatus 1, for example. The X-Y coordinate system has an origin O that is a left corner of the adhesive layer 10*v* of the holding sheet 10 as shown in FIG. 1, and the holding sheet 10 (the object S) and the cutter C are moved relative to each other based on the X-Y coordinate system.

The cutting apparatus 1 of the example includes a scanner 6 serving as an image reading instrument which reads image information of the object S as shown in FIG. 2. The scanner 6 is constituted by a contact image sensor (CIS), for example. The contact image sensor includes a line sensor constituted by a plurality of imaging devices is arranged in a line in the X direction, for example. The scanner 6 is located in the rear of the guide rail 22 so as to be directed downward and has a length substantially equal to the width of the holding sheet 10. The scanner 6 has an underside provided with a sensing part (contact glass) which reads an image of the object S in proximity to the upper side of the object S held by the holding sheet 10. More specifically, the object S passes the underside of the scanner 6 when the holding sheet 10 is moved in the Y direction. In this case, the control circuit 91 executes an imaging process in which imaging is carried out at imaging intervals according to a moving speed of the holding sheet 10 so that an image range of the object S read by the scanner 6 is continuous. As a result, a color image of the object S on the holding sheet 10 is generated.

The arrangement of the control system of the cutting apparatus 1 will now be described with reference to FIG. 6. The control circuit 91 (a control device) controlling the entire cutting apparatus 1 is mainly constituted by a computer (CPU). The ROM 92, the RAM 93 and the external memory 94 are connected to the control circuit 91. The ROM 92 stores a cutting control program for controlling a cutting operation and a display control program for controlling a displaying manner of the display 9*a*. The ROM 92 also stores a cutting data generating program which will be described in detail later, operation table information and the like. The operation information table contains detection information supplied from the type detection sensors 83A to 83C and operation information both correlated with each other. The operation information includes a cutter pressure set for every type of cartridge 4 and relative movement speeds (speed data of the Y-axis motor 15 and the X-axis motor 25). The RAM 93 temporarily stores data and programs required for various processes. The external memory 94 stores cutting data for cutting a plurality of types of patterns.

To the control circuit 91 are supplied a signal generated by a sheet detection sensor for detecting a distal end of the holding sheet 10 set on the platen 3, a signal generated by a raised position detection sensor 45, signals generated by the respective type detection sensors 83A to 83C and the like. The display 9*a* and the operation device 9*a* including the operation switches are also connected to the control circuit 91. While viewing a screen of the display 9*a*, a user can operate various switches of the operation device 9*b* to select a processing mode and to set various parameters. To the control circuit 91 are further connected drive circuits 97, 98 and 99 for driving the Y-axis motor 15, the X-axis motor 25 and the Z-axis motor 38 respectively. The control circuit 91 controls the Y-axis motor 15, the X-axis motor 25, the Z-axis motor 38 and the like so that an operation of cutting the object S held on the holding sheet 10 is automatically executed. A cutting data generator 90 is constituted by the control circuit 91, the storage units such as the ROM 92 and the RAM 93, the display 9*a*, the operation switches of the operation device 9*b*.

In the first example, the cutting data generating program is executed to make a sheet material defining an arrangement of granular decorative pieces. Rhinestones 100 which are one type of resinous artificial gems are used as the granular decorative pieces. The rhinestones 100 are each formed into a substantially circular shape and have colors of red, blue, green, rose, emerald green and the like, as shown in the enlarged plan view of FIG. 7A. For example, each rhinestone 100 has a surface to which a facet cut is applied and a reverse side which is formed with a flat face and has a hot melt layer, for example. Accordingly, each rhinestone 100 can be bonded and fixed to clothes or the like by heat generated by a clothes iron.

A plurality of figures indicative of an arrangement of the rhinestones 100 is printed on the sheet material before cut by the cutting apparatus 1. A resin sheet (or printing paper) is used as the sheet material which is the object S to be cut. In the following description, the sheet material is referred to as "object S" before it is cut, so as to be discriminated from the sheet material made by the cutting.

Figure 8:
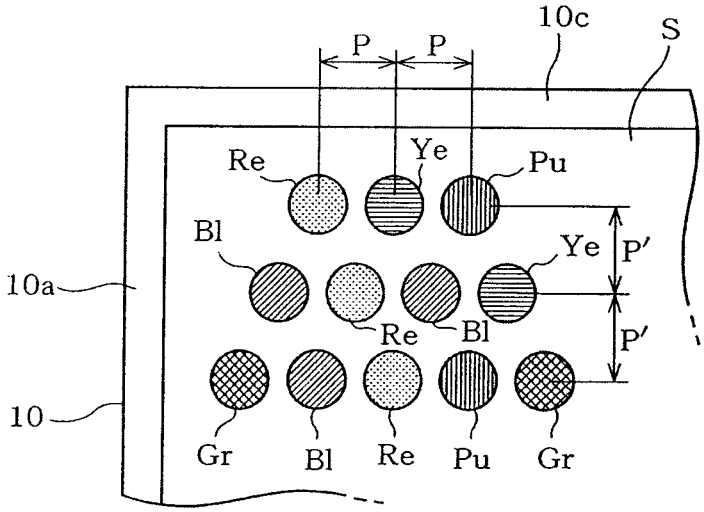
FIG. 8 illustrates a sheet material adherent to a holding sheet before holes are formed.

The object S has twelve circular figures printed thereon, that is, three circles on an uppermost column, four circles on a middle column and five circles on a lowermost column, as shown in FIG. 8. These circles represent an arrangement of rhinestones 100 arranged in the right-left direction and the up-down direction with predetermined pitches p and p'. Symbols "Re," "Pu," "Ye," "Gr" and "Bl" represent colors of the circles, that is, red, purple, yellow, green and blue, corresponding to color types of the rhinestones 100.

Figure 10:
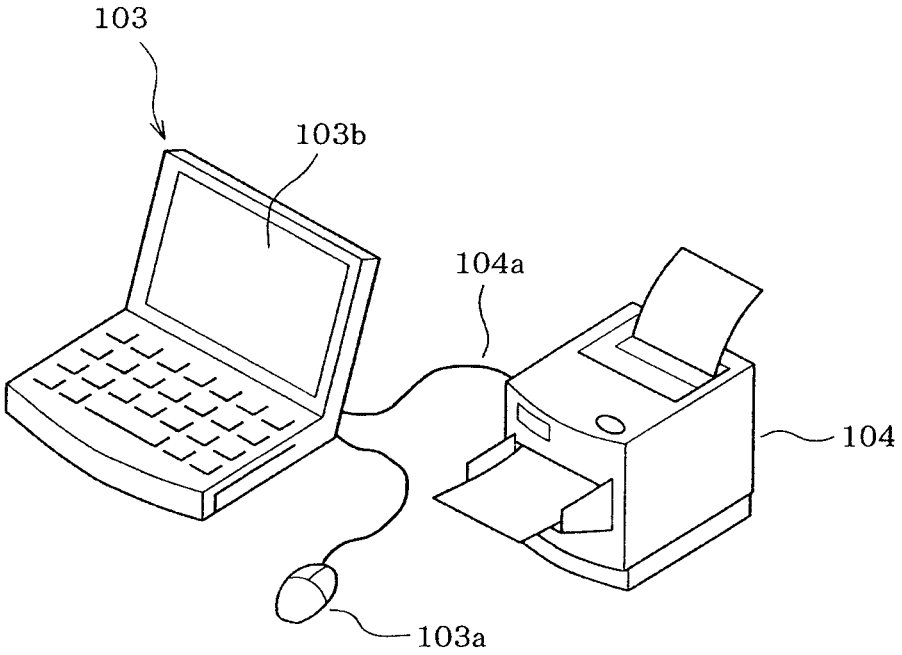
FIG. 10 schematically illustrates an example of a unit which prints on the sheet material.

The figures can be printed on the object S using a personal computer (PC 103) and a color printer 104 as shown in FIG. 10. The PC 103 includes a control circuit which is mainly constituted by a computer (CPU) and to which are connected a storage section storing a plotting software and the like, an input section including an mouse 103*a*, a key board and the like and a display section 103*b* constituted by an LCD. The user operates the mouse 103*a* and the like to plot a figure on the plotting software. The figure preferably has a circular shape similar to the rhinestone 100.

Figure 7A:
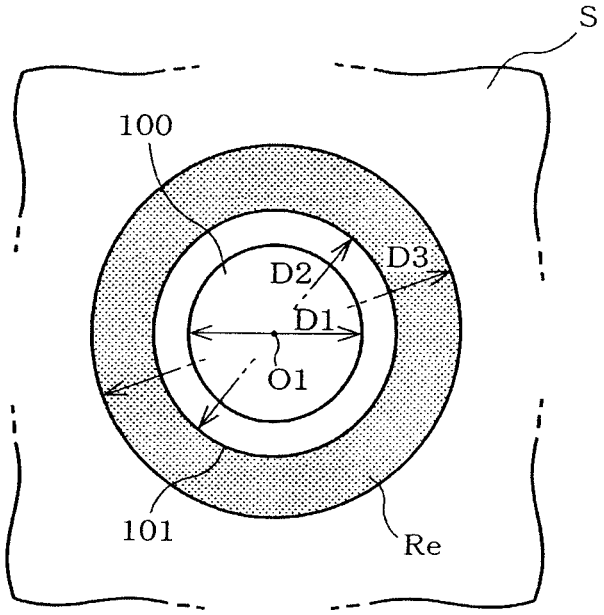
FIG. 7A is an enlarged plan view showing the relationship between a rhinestone and a hole.
Figure 7B:
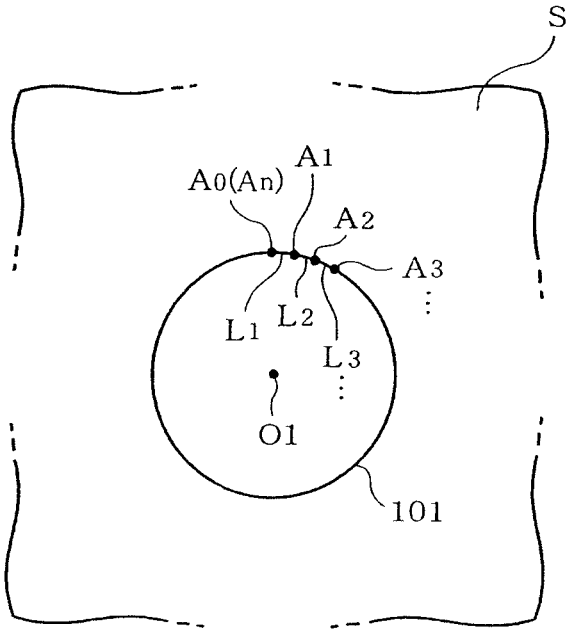
FIG. 7B is a diagram showing cutting data.

The figure is plotted so as to have a diameter D3 which is larger than the diameter D1 of the rhinestone 100 by a predetermined amount and is equal to or smaller than a smaller pitch p of the rhinestones 100 (D1<D3≤p), as shown in FIG. 7A. The arrangement of the rhinestones 100 can be set optionally on the basis of a pitch p desired by the user, the number of rhinestones to be used, and the like. The colors of the figures are individually designated according to the color types of the rhinestones 100. The PC 103 generates print data of the figures plotted using the plotting software.

The color printer 104 serving as an output device of the PC 103 is connected via a cable 104*a* to the PC 103. When the print data generated at the PC 103 side is transferred to the color printer 104, the color printing is executed for the object S by the color printer 104. The unit which prints a figure on the object S should not be limited to the PC 103 and the color printer 104. Any unit may be used which can print the arrangement of the rhinestones 100 and the figure representing the colors of the rhinestones 100. The object S should not be limited to the figure plotted by the user and printed. A printed typical arrangement pattern of rhinestones 100 (a pattern of linearly arranged figures, for example) may be used.

Figure 9:
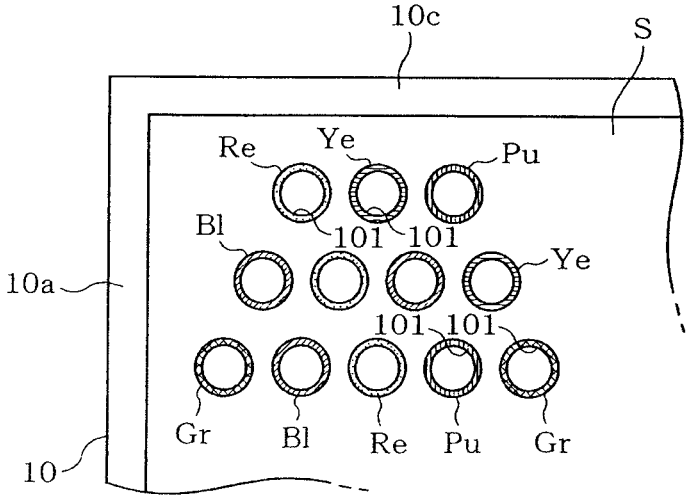
FIG. 9 is a view similar to FIG. 8, showing the sheet material in which holes have been formed.

The cutting data will be described with an exemplified case where the holes 101 are cut from the object S and the sheet material is made. More specifically, as shown in FIGS. 7A and 9, it is assumed that twelve circular holes 101 which are sized so that the rhinestones 100 are fitted into the circular holes 101 are cut from the object S. The cutting data in this case includes cutting line data, delimiter data and displaying data. The cutting line data is comprised of X-Y coordinate value data representing apexes of a cutting line including a plurality of line segments and defined by the X-Y coordinate system of the cutting apparatus 1.

More specifically, the cutting line of holes 101 is comprised of line segments L1, L2, L3, . . . connecting between cutting start points $A_0$, apex $A_1$, apex $A_2$, . . . and cutting end point $A_n$. The cutting line is formed into a substantially circular shape by setting an interapex distance to a smaller value as a whole and the cutting start point $A_0$ corresponds with the cutting endpoint $A_n$. The cutting line data has first coordinate data, second coordinate data, third coordinate data, . . . and (n+1)-th coordinate data corresponding to the cutting start point $A_0$, apex $A_1$, apex $A_2$, . . . and (n+1)-th coordinate data respectively.

In the cutting of the holes 101, the cutter C is relatively moved to the X-Y coordinate of the cutting start point $A_0$ by the transfer mechanism 7 and the carriage moving mechanism 8. Next, the blade edge C1 of the cutter C is caused to penetrate the cutting start point $A_0$ of the object C by the up-down drive mechanism 33 and relatively moved by the transfer mechanism 7 and the carriage moving mechanism 8 so that the apex $A_1$, apex $A_2$, apex $A_3$, . . . are sequentially connected by straight lines. Thus, the line segments L1, L2, L3, . . . are cut sequentially continuously, whereby the cutting line forming the circular hole 101 is cut.

The cutting line data is configured to be generated in correspondence relationship with twelve figures as will be described in detail later. The twelve holes 101 are cut based on the cutting line data. Delimiter data is affixed to data end of each cutting line data. The blade edge C1 of the cutter C is departed from the object S by the up-down drive mechanism 33 every time one cutting line is cut, based on the delimiter data.

Figure 11:
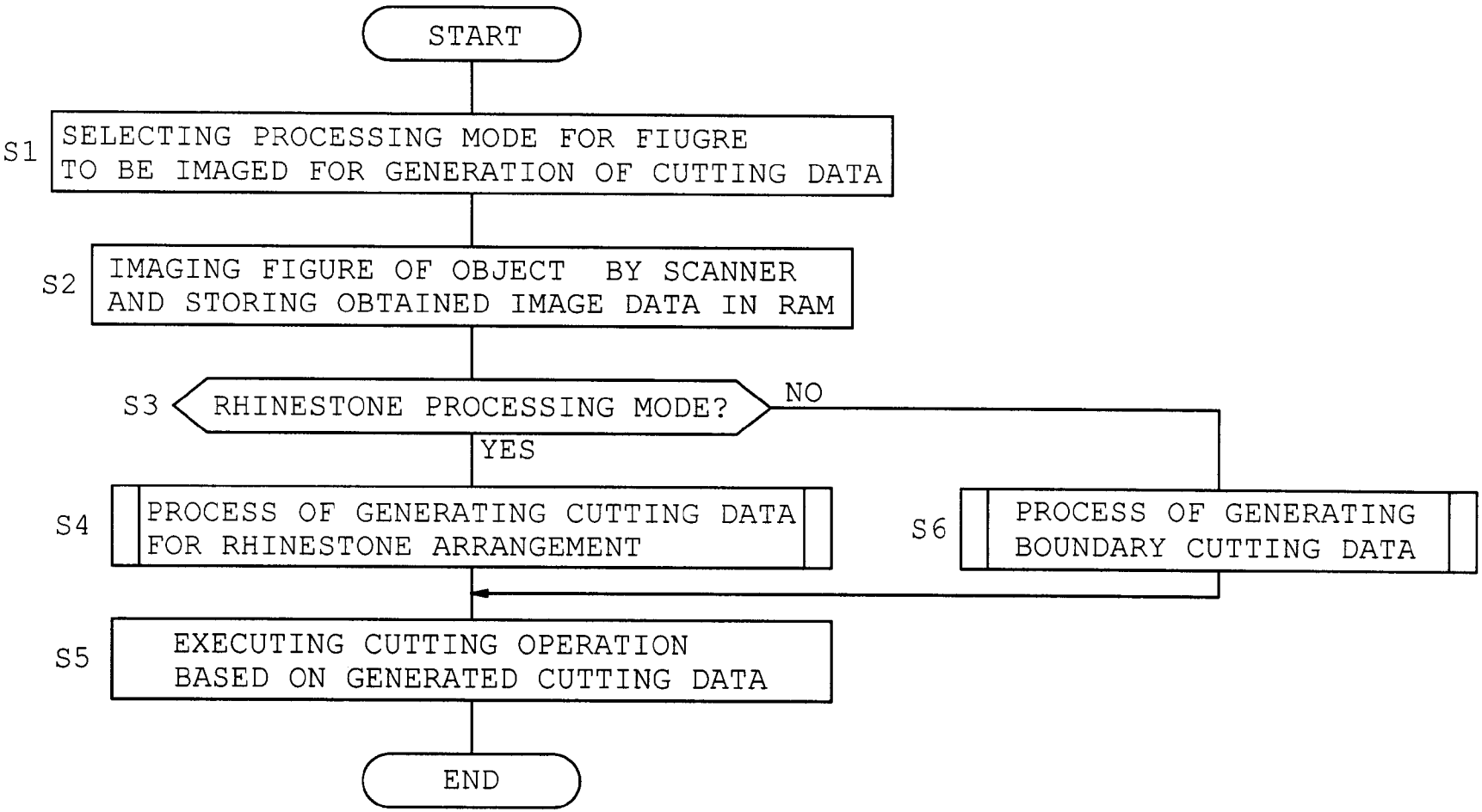
FIG. 11 is a flowchart showing a sequence of processing executed on a cutting data generating program and cut processing.
Figure 12:
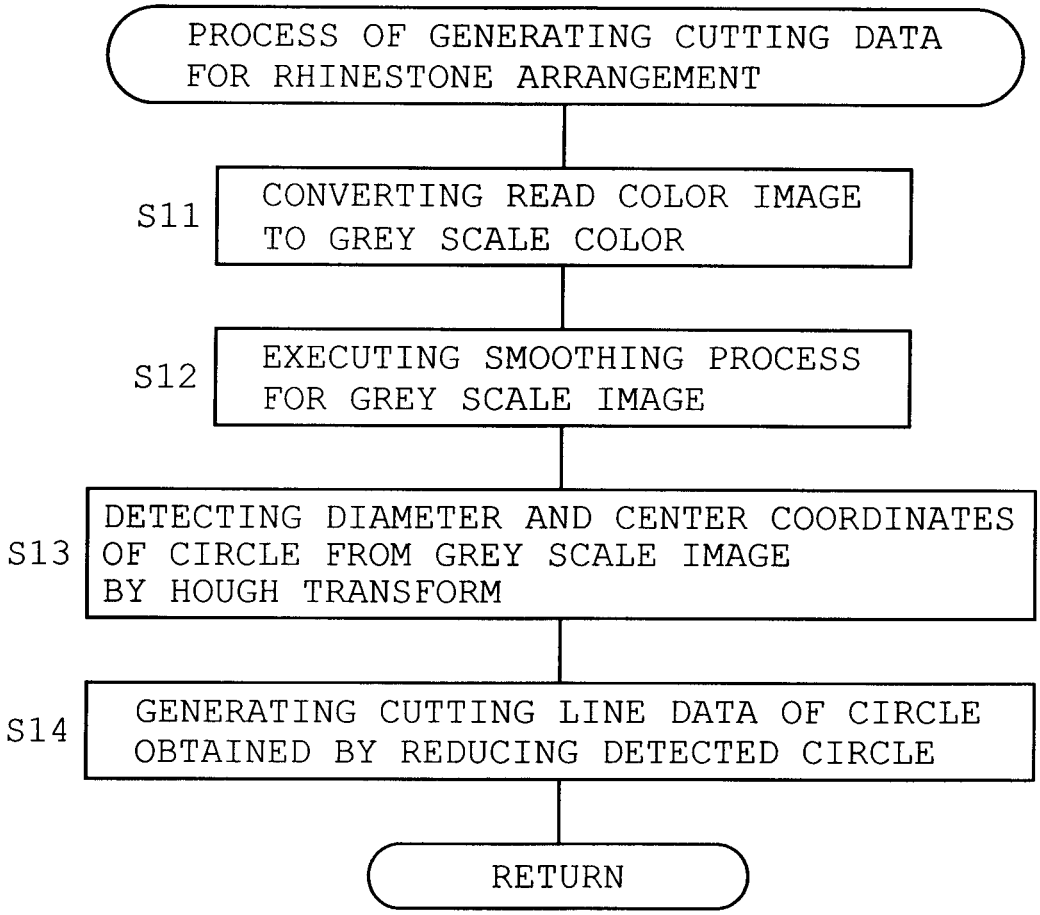
FIG. 12 is a flowchart showing processing for cutting data generation for rhinestone arrangement.

The first example employs a rhinestone processing mode and a boundary processing mode in order that the cutting data may be generated from the image data of the object S imaged by the scanner 6 (see steps S4 and S6 in FIG. 11). The rhinestone processing mode generates cutting data of holes 101 for rhinestones 100 smaller than the figure of the object S. On the other hand, the boundary processing mode generates a cutting line along an outline (boundary of colors) of the figure of the object S. Since the boundary processing mode uses a known technique, a detailed description of the boundary processing mode will be eliminated.

In the rhinestone processing mode, the control circuit 91 sets an arrangement position of the hole 101 so that center positions of the figure and the hole 101 correspond with each other, based on the position information of the figure of the imaged object S. Cutting data of the cutting line of the hole 101 is generated so that a diameter D2 of the hole 101 is smaller than a diameter D3 of the figure and larger than a diameter D1 of the rhinestone 100 (D1<D2<D3). The cutting data generating program contains a default usable to reduce the diameter D3 of the figure. The control circuit 91 executes calculation with the use of the diameter D3 and the default to set the size of the cutting line of the hole 101 to a value smaller by a predetermined amount than the figure.

The operation of the cutting apparatus thus constructed and arranged will be described with reference to FIGS. 11 to 13D. FIG. 11 is a flowchart showing the processing executed by the control circuit 91 on the cutting data generating program and a sequence of cutting processes. In the following description, a resin sheet is used as the object S to be cut. The aforementioned twelve circular figures are printed in red, purple, yellow, green and blue colors on the resin sheet. The object S is to be applied to the holding sheet 10 as shown in FIG. 1. The circular figures are somewhat exaggerated for the purpose of illustration.

The user firstly sets the holding sheet 10 holding the object S on the platen 3 of the cutting apparatus 1. When the sheet detection sensor 96 detects the insertion of the holding sheet 10 in this case, the control circuit 91 sets as an origin O a left corner of the adhesive layer 10*v* of the holding sheet 10. The user then operates one or more operation switches of the operation device 9*b* to cause the display 9*a* to display a menu screen (not shown), instructing "image scan→generation of cutting data" on the menu screen. As a result, the processing of the cutting data generating program starts.

The control circuit 91 causes the display 9*a* to display a processing mode selection screen (not shown) to select the processing mode. The user operates the operation device 9*b* to select either the rhinestone processing mode or the boundary processing mode (step S1). The control circuit 91 moves the holding sheet 10 backward to the scanner 6 side and executes the imaging process when the object S passes the underside of the scanner 6. The control circuit 91 causes the RAM 93 to store data of a color image (see FIG. 13A) generated by the imaging process (step S2).

Figure 13A:
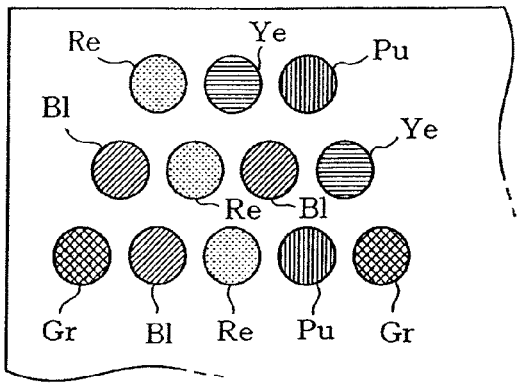
FIGS. 13A to 13D are diagrams showing a procedure for generating cutting data.
Figure 13B:
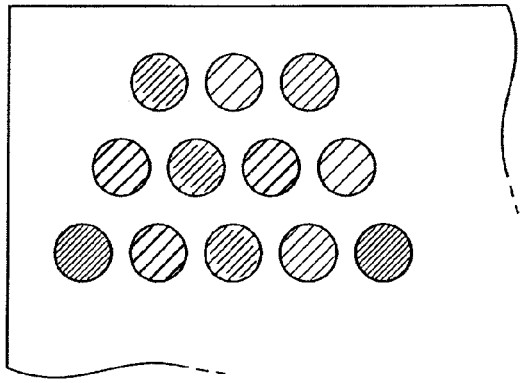
Figure 13C:
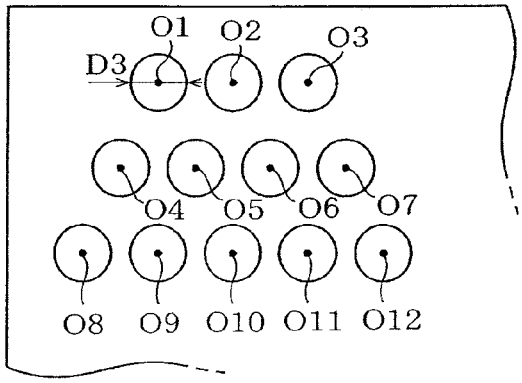
Figure 13D:
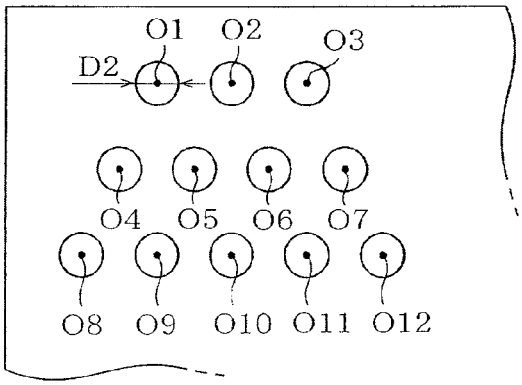

The control circuit 91 then determines whether or not the processing mode selected at step S1 is the rhinestone processing mode. When the rhinestone processing mode has been selected (YES at step S3), the control circuit 91 proceeds to step 4 for a process of generating cutting data for rhinestone arrangement (see FIG. 12). In the rhinestone processing mode, the color image generated at step S2 is converted to a grey scale image as shown in FIG. 13B (step S11). The grey scale image is an image represented by light and shade by equalizing RGB values of respective pixels in the color image. Accordingly, an amount of arithmetic processing can be reduced as the result of conversion to the grey scale image. Furthermore, since variations of the RGB values in the original color image is reduced, detection (extraction) of an outline of the figure can be rendered easier. The control circuit 91 further executes a smoothing process for the grey scale image (step S12) and reduction of noise contained in the grey scale image. At step S11, a binarized image may be generated by binarizing the color image or the grey scale image with the use of a predetermined threshold. In this case, too, an amount of arithmetic processing can be reduced and detection of an outline of the figure can be rendered easier.

The control circuit 91 executes a Hough transform to detect a central coordinate and a diameter of an outline of the figure, that is, the circular configuration from the grey scale image (step S13). In this case, diameters and center positions of the circular configurations of twelve figures are extracted according to an algorithm of the Hough transform known in an image processing library such as Open CV. This can obtain the diameter D3 of circular configuration indicative of an arrangement of the rhinestones 100 and X coordinates and Y coordinates of center positions O1 to O12 as position information.

The control circuit 91 subsequently generates cutting data based on the obtained position information and the diameter D3 of the circular configurations. In this case, the control circuit 91 sets arrangement positions of the respective holes 101 so that the center positions O1 to O12 of the circular configurations correspond with center positions of holes to be cut (step S14). The diameter D2 of the hole 101 is set so as to be smaller than the diameter D3 by the use of the predetermined default. Thus, the control circuit 91 calculates coordinate values (first coordinate data, second coordinate data, . . . ) of a cutting line fitting inside the circular figure. The control circuit 91 sets coordinate values of the cutting line data of the center positions O1 to O12 regarding the twelve holes 101. The control circuit 91 further adds the limiter data to end of the cutting line data and causes the RAM 93 to store the cutting line data with the delimiter data, returning to step S5 in FIG. 11.

When determining that the cartridge 4 for the cutting of the hole 101 of the rhinestones 100 has not been attached, based on the detection signals of the type detection sensors 83A to 83C, the control circuit 91 causes the display 9*a* to display that effect. The user then attaches the cartridge 4 to the cartridge holder 32 and switches the lever member 60 from the open position to the fixed position, thereby fixing the cartridge 4 (see FIG. 4). When having detected the type of the cartridge 4 based on the detection signals of the type detection sensors 83A to 83C, the control circuit 91 executes a cutting operation upon receipt of the instruction of "start cutting" by the operation of operation device 9*b* (step S5).

In this case, the control circuit 91 causes the cutter C to relatively move based on the cutting data, so that twelve holes 101 corresponding to the respective figures are formed in the object S (see FIG. 9). In the cutting, the control circuit 91 collates the operation information table to set data of cutter pressure and speed data according to the type of the cartridge 4. Accordingly, the Y-axis motor 15 and the X-axis motor 25 are driven based on the cutting data and speed data, whereby the hole 101 can be cut at a cutting speed suitable for the type of object S. Furthermore, a cutter pressure suitable for the object S is applied thereto during the cutting. Consequently, the object S is prevented from being displaced from the holding sheet 10 due to the cutter pressure, whereby the motors 15 and 25 can be controlled so as to be prevented from step-out. Additionally, since the cartridge 4 is pressed and fixed by the lever member 60 in the cartridge holder 32, a stable high-precision cutting can be executed and even a minute hole 101 can reliably be cut out.

A sequence of processing regarding the generation of cutting data and the cutting operation ends upon completion of the cutting of the twelve holes 101. Upon end of the above-described processing, the user can use the object S removed from the holding sheet 10 as a sheet material for arrangement of rhinestones 100. As shown in FIG. 9, the printed figures of colors of red Re, purple Pu, yellow Ye, green Gr and blue Bl representing an arrangement of the rhinestones 100 surround the respective holes 101 in annular or ring shapes on the sheet material. Accordingly, a coloration image of the overall rhinestones 100 can be represented by the colors Re, Pu, Ye, Gr and Bl on the sheet material. Furthermore, the rhinestones 100 can easily be fitted into the respective holes 101 without error in the colors. The rhinestones 100 positioned by the holes 101 of the sheet material are bonded to clothes with the use of, for example, a clothes iron (not shown).

When the boundary processing mode is selected at step S1 (NO at step S3), the control circuit 91 proceeds to step S6 to execute a cutting data generating process to cut boundaries of the figures. In this case, cutting data to be generated represents a cutting line corresponding with an outline of the figure of the object S imaged by the scanner 6. Accordingly, a cutting process is executed in which the printed figures are cut out along respective outlines.

As understood from the foregoing, the control circuit 91 and the scanner 6 in relation to execution of step S13 serve as a position information obtaining unit. The control circuit 91 executes a position information obtaining step to obtain position information of the figures printed on the object S. The control circuit 91 serves as a second extracting unit which extracts the diameter D3 and the center positions O1 to O12 of the circular configurations at step S13. The control circuit 91 sets arrangement positions of the holes 101 so that the center positions O1 to O12 correspond with the center positions of the holes 101 respectively. At step S13, arrangement positions of the holes 101 may be set by assigning the holes 101 so that the holes partially overlap the respective figures or so that the holes 101 come close to the respective figures. In each case, too, cutting data in which the figures and the holes correspond to one another can be generated.

The control circuit 91 in the first example thus serves as an arrangement unit and a cutting data generating unit. Based on the position information obtained at the position information obtaining step, the control circuit 91 executes an arrangement step of assigning the holes 101 so that the holes 101 partially overlap the respective figures or so that the holes 101 come close to the respective figures, thereby setting arrangement positions of a plurality of holes 101 on the sheet material and further executes a cutting data generating step of generating cutting data for cutting a plurality of holes 101 while the arrangement positions set by the arrangement unit serve as cutting positions on the sheet material (see steps S13 and S14 in FIG. 12).

According to the above-described arrangement, cutting data is generated in which the holes 101 are assigned so that the holes 101 at least partially overlap a plurality of figures printed on the sheet material, respectively or so that the holes 101 come close to the respective figures. Consequently, the cutting apparatus 1 can form in the sheet material the holes 101 corresponding to a plurality of figures respectively, based on the cutting data. Accordingly, the colors of the rhinestones 100 arranged in the respective holes 101 in the sheet material can be specified, with the result that a plurality of types of rhinestones 100 with different colors can be arranged easily and precisely.

The position information obtaining unit includes the image reading instrument which reads image information of the sheet material. According to this arrangement, the position information of each figure can be obtained based on the image information read by the image reading instrument, with the result that the arrangement position of the hole 101 can be set further precisely.

The figure has a larger size by a predetermined amount than the rhinestone 100. The control circuit 91 serves as a first extracting unit which extracts an outline of the figure (step S13 in FIG. 12) and sets an arrangement position of the hole 101 inside the outline in the sheet material, based on the extracted outline. According to this arrangement, the correspondence of the figures to the respective holes 101 can be understood more easily and accordingly, a plurality of rhinestones 100 with different colors can be arranged in the respective holes 101 further precisely. Furthermore, an entire coloration image can be represented further precisely by the figure colors Re, Pu, Ye, Gr and Bl on the sheet material before the rhinestones 100 are arranged on the sheet material.

The figure is formed into the circular shape having a diameter D3 which is larger than the diameter D2 of the rhinestone 100 by the predetermined amount. The control circuit 91 sets the arrangement position of the hole 101 relative to the sheet material (the object S) so that the center positions O1 to O12 of the circular configurations extracted by the second extracting unit correspond with the center positions of the holes 101 respectively. According to this arrangement, the figure representing the colors Re, Pu, Ye, Gr and Bl of the rhinestones 100 are formed into the annular shape and surround the respective holes 101. Accordingly, the colors of the rhinestones 100 arranged in the respective holes 101 can be clearly represented and get good-looking.

Each figure is formed into a circular shape and has a larger diameter D3 than the diameter D2 of each rhinestone 100 by the predetermined amount. The control circuit 91 serves as the third extracting unit which converts the image read by the image reading instrument to the grey scale image or binarizes the read image (step S11). The third extracting unit extracts the diameters and center positions O1 to O12 of the circular figures from the grey scale images or binarized images by the Hough transformation (step S13). The third extracting unit sets the arrangement positions of the holes 101 on the sheet material so that the center positions of O1 to O12 of the extracted circular figures correspond with the center positions of the holes 101 respectively. According to this arrangement, the diameters and center positions O1 to O12 of the circular figures are extracted based on the grey scale or binarized images. Consequently, an amount of arithmetic processing can be reduced and the detection of the diameters and the center positions O1 to O12 of the circular figures can be rendered easier. Furthermore, the third extracting unit can achieve the advantageous effect that the colors of the rhinestones 100 arranged in the respective holes 101 can be represented clearly and other effects. Thus, the third extracting unit can achieve the same advantageous effects as the second extracting unit.

Figure 14:
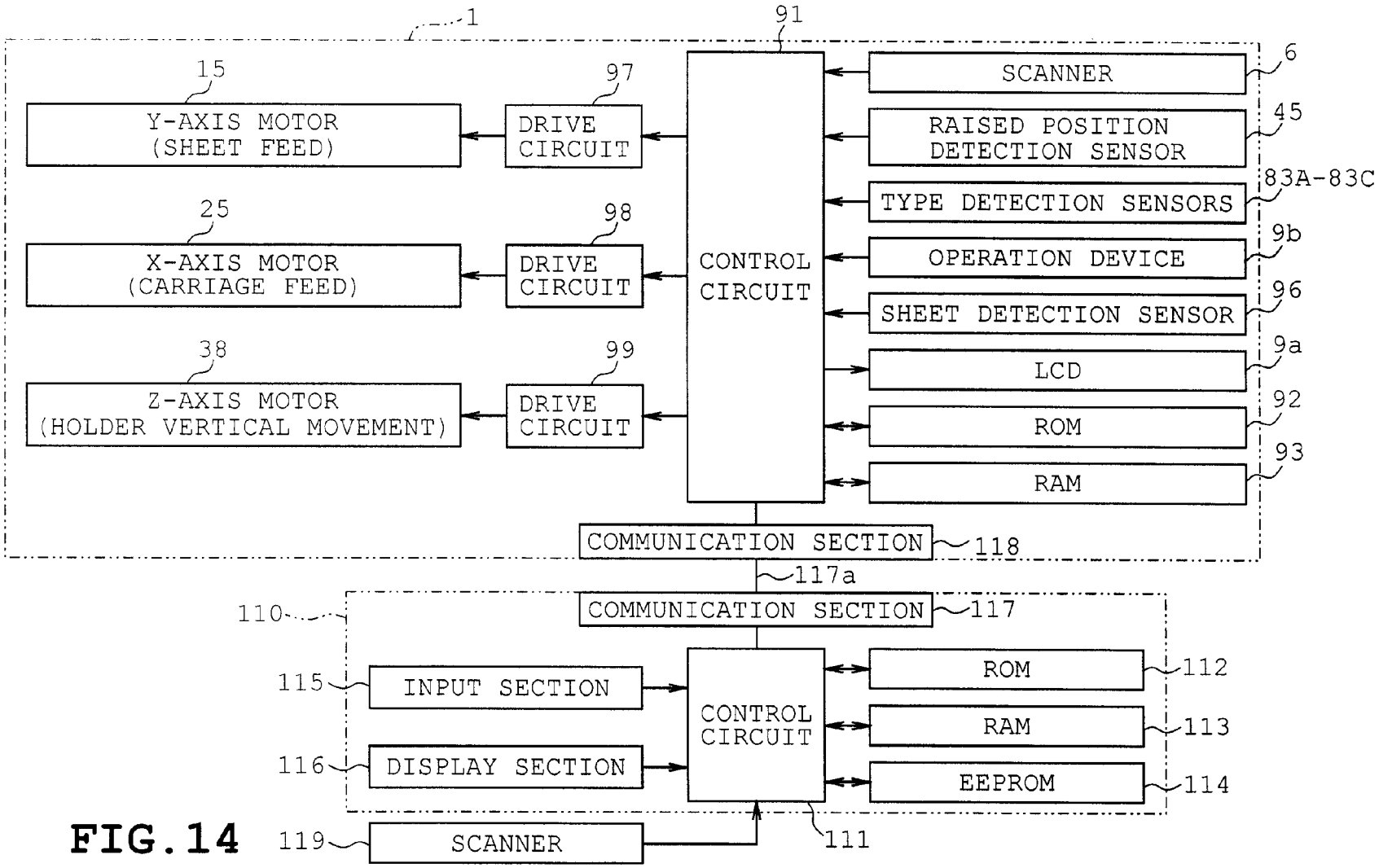
FIG. 14 is a view similar to FIG. 6, showing a second example.

FIG. 14 illustrates a second example. Only the difference between the first and second examples will be described in the following. Identical or similar parts in the second example are labeled by the same reference symbols as those in the first example.

A personal computer (hereinafter, "PC 110") as shown in FIG. 14 is configured as a cutting data generator which generates the above-described cutting data. More specifically, the PC 110 includes a control circuit 111 which is a control device mainly composed of a computer (CPU). A ROM 112, a RAM 113 and an EEPROM 114 are connected to the control circuit 111. To the PC 110 are connected an input section 115 including a keyboard and a mouse both of which are operated by the user to enter various instructions, selections and other inputs. The PC 110 is further provided with a display (an LCD, for example) which displays necessary messages and the like to the user. A scanner 119 serving as an image reading instrument is further connected to the PC 110 so that image information of the object S is obtained by the PC 110. The PC 110 and the scanner 119 constitute a position information obtaining unit.

The PC 110 includes a communication section 117 for wired or wireless connection to the user. The communication section 117 is connected, for example, via a cable 117*a* to a communication section 118 of the cutting apparatus 118, whereby transmission/reception of data including the cutting data is executable between the PC 110 and the cutting apparatus 1. The control circuit 111 controls the entire PC 110 and executes the cutting data generating program and the like. The ROM 112 stores the cutting data generating program, an operation information table and the like. The RAM 113 temporarily stores image information read by the scanner 119, the cutting data and data and programs both necessary for execution of various processing. The EEPROM 114 stores various cutting data and the like.

The control circuit 11 is configured to be capable of executing processing on the cutting data generating program, that is, steps S4 and S6 in FIG. 11. As a result, the control circuit 111 generates cutting data in which the holes 101 are assigned to the respective figures so that the holes 101 at least partially overlap or so that the holes 101 come close to the respective figures, based on the position information of the respective figures of the sheet material, in the same manner as in the first example, thereby generating cutting data in which arrangement positions of a plurality of holes 101 is set relative to the object S.

As understood from the foregoing, the control circuit 111 is configured as the position information obtaining unit, the arrangement unit, the cutting data generating unit, the first extracting unit, the second extracting unit and the third extracting unit in the same manner as in the first example. Accordingly, the PC 110 can generate the cutting data for forming in the object S the holes 101 corresponding to a plurality of figures, based on the cutting data. As a result, the PC 110 can achieve the same advantageous effects as the cutting data generator 90. Thus, when the generated cutting data is read into the computer of the cutting apparatus 1 and the cutting process at step S5 is executed, the sheet material defining the arrangement of the rhinestones 100 can be made.

The foregoing examples should not be restrictive but may be changed or expanded as follows. The printing data and the cutting data should not be limited to the rhinestones 100 but may be generated with respect to the sheet material defining arrangement of various types of granular decorative pieces.

Regarding the types of the decorative pieces, the size, the shape and the like may be caused to differ other than the colors.

The invention should not be limited to the cutting apparatus 1 as the above-described cutting plotter but may be applied to various apparatuses each provided with the cutting instrument. The color printer 104 in the first example may be connected to the PC 110 so that the arrangement of the rhinestones 100 and the figures representing the arrangement of the rhinestones 100 and the colors of the respective rhinestones 100 are printed on the object S in a color printing manner. The figure should not be limited to the above-described circular shape but may have various shapes such as a polygonal shape. The image reading instrument should not be limited to the scanner 6 or 118 but may be constituted by another image reading instrument capable of imaging a color image or another image reading instrument capable of imaging a monochrome image.

Instructions on the cutting data generating program should not be limited to those stored in the storage unit in the cutting apparatus 1 or the PC 110. The instructions may be stored in a non-transitory computer-readable medium (storage medium) such as a USB memory, a CD-ROM, a flexible disc, a DVD and a flash memory. In this case, when instructions stored in the recording medium is read by each of computers of various types of data processors and executed, the modified form can achieve the same advantageous effects as the foregoing example.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cutting data generator generating cutting data comprising:

a control device configured to:

obtain position information of a plurality of figures printed on a sheet material, the figures representing an arrangement of a plurality of types of decorative pieces having at least different colors, the figures being capable of identifying the types of the decorative pieces;

set arrangement positions of a plurality of holes in the sheet material based on the obtained position information, the arrangement positions being positions where the holes partially overlap the figures respectively or where the holes come close to the figures respectively, the holes defining an arrangement of the decorative pieces; and generate cutting data usable to cut the holes through the sheet material based on the set arrangement positions.

2. The cutting data generator according to claim 1, further comprising an image reading instrument configured to read image information about the sheet material.

3. The cutting data generator according to claim 2, wherein the figures are circular in shape and have larger diameters than the decorative pieces by a predetermined amount, and the control device is configured to:

convert the image read by the image reading instrument to a grey scale image or to bianarize the read images thereby to extract diameters and center positions of the circular figures by a Hough transform from the grey scale images or the binarized images; and set arrangement positions of the holes in the sheet material so that the extracted center positions of the circular figures correspond with center positions of the holes respectively.

4. The cutting data generator according to claim 1, wherein the control device is configured to extract outlines of the figures, each figure having larger dimensions by a predetermined amount than each decorative piece, and to set arrangement positions of the holes inside the outlines in the sheet material based on the extracted outlines.

5. The cutting data generator according to claim 1, wherein the figures are circular in shape and have larger diameters than the decorative pieces by a predetermined amount respectively and the control device is configured to extract diameters and center positions of the circular figures respectively and to set arrangement positions of the holes in the sheet material so that the center positions of the circular figures correspond with center positions of the holes respectively.

6. A non-transitory computer-readable storage medium storing computer-readable instructions that, when executed by a processor, cause the processor to perform the steps of:

obtaining position information of a plurality of figures printed on a sheet material, the figures representing an arrangement of a plurality of types of decorative pieces having at least different colors, the figures being capable of identifying the types of the decorative pieces;

setting arrangement positions of a plurality of holes in the sheet material based on the obtained position information, the arrangement positions being positions where the holes partially overlap the figures respectively or where the holes come close to the figures respectively, the holes defining an arrangement of the decorative pieces; and generating cutting data usable to cut the holes through the sheet material based on the set arrangement positions.

7. The storage medium according to claim 6, further storing computer-readable instructions that, when executed by the processor, cause the processor to perform the steps of:

extracting outlines of the figures, each figure having larger dimensions by a predetermined amount than each decorative piece; and setting arrangement positions of the holes inside the outlines in the sheet material based on the extracted outlines.

8. The storage medium according to claim 6, wherein the figures are circular in shape and have larger diameters than the decorative pieces by a predetermined amount respectively, the storage medium further storing computer-readable instructions that, when executed by the processor, cause the processor to perform the steps of:

extracting diameters and center positions of the circular figures respectively; and setting arrangement positions of the holes in the sheet material so that the center positions of the circular figures correspond with center positions of the holes respectively.

9. The storage medium according to claim 6, wherein the figures are circular in shape and have larger diameters than the decorative pieces by a predetermined amount, the storage medium further storing computer-readable instructions that, when executed by the processor, cause the processor to perform the steps of:

converting the image read by the image reading instrument to a grey scale image or binarizing the read images thereby to extract diameters and center positions of the circular figures by a Hough transform from the grey scale images or the binarized images; and setting arrangement positions of the holes in the sheet material so that the extracted center positions of the circular figures correspond with center positions of the holes respectively.

10. A cutting apparatus comprising:

a cutting date generator generating cutting data and including a control device configured to:

obtain position information of a plurality of figures printed on a sheet material, the figures representing an arrangement of a plurality of types of decorative pieces having at least different colors, the figures being capable of identifying the types of the decorative pieces;

set arrangement positions of a plurality of holes in the sheet material based on the obtained position information, the arrangement positions being positions where the holes partially overlap the figures respectively or where the holes come close to the figures respectively, the holes defining an arrangement of the decorative pieces; and generate cutting data usable to cut the holes through the sheet material based on the set arrangement positions; and a cutting instrument configured to cut the holes through the sheet material based on the cutting data.

11. The apparatus according to claim 10, further comprising an image reading instrument configured to read image information of the sheet material.

12. The apparatus according to claim 11, wherein the figures are circular and have larger diameters than the decorative pieces by a predetermined amount, and the control device is configured to:

convert the image read by the image reading instrument to a grey scale image or to bianarize the read images thereby to extract diameters and center positions of the circular figures by a Hough transform from the grey scale images or the binarized images; and set arrangement positions of the holes in the sheet material so that the extracted center positions of the circular figures correspond with center positions of the holes respectively.

13. The apparatus according to claim 10, wherein the control device is configured to extract outlines of the figures, each figure having larger dimensions by a predetermined amount than each decorative piece, and to set arrangement positions of the holes inside the outlines in the sheet material based on the extracted outlines.

14. The apparatus according to claim 10, wherein the figures are circular and have larger diameters than the decorative pieces respectively, and the control device is configured to extract diameters and center positions of the circular figures respectively and to set arrangement positions of the holes in the sheet material so that the center positions of the circular figures correspond with center positions of the holes respectively.

* * * * *